US006173837B1

(12) United States Patent
Marconi

(10) Patent No.: US 6,173,837 B1
(45) Date of Patent: Jan. 16, 2001

(54) CARRYING CASE WITH INTERCHANGEABLE SIDE PANELS

(76) Inventor: Elizabeth Marconi, 2604 Highland Ave., Manhattan Beach, CA (US) 90266

( * ) Notice: Under 35 U.S.C. 154(b), the term of this patent shall be extended for 0 days.

(21) Appl. No.: 09/444,447

(22) Filed: Nov. 22, 1999

(51) Int. Cl.[7] ..... B65D 73/00; A45C 13/00
(52) U.S. Cl. ..... 206/457; 40/312; 190/125
(58) Field of Search ..... 206/459.1, 457; 190/26, 124, 125; 40/312

(56) References Cited

U.S. PATENT DOCUMENTS

| | | | | |
|---|---|---|---|---|
| Re. 34,361 | | 8/1993 | Pratt . | |
| 2,438,780 | * | 3/1948 | Hochner | 190/125 X |
| 3,575,226 | | 4/1971 | Chapman . | |
| 3,710,901 | | 1/1973 | Guard et al. . | |
| 4,938,326 | | 7/1990 | Pfeiffer . | |
| 5,009,319 | | 4/1991 | Jantzen . | |
| 5,400,903 | | 3/1995 | Cooley . | |
| 5,529,184 | | 6/1996 | Sadow . | |
| 5,533,558 | * | 7/1996 | Carey et al. | 190/26 X |
| 5,560,479 | | 10/1996 | Leyba et al. . | |
| 5,607,054 | | 3/1997 | Hollingsworth . | |
| 5,775,497 | | 7/1998 | Krulik . | |
| 5,803,266 | * | 9/1998 | Blackwelder | 206/458 X |
| 5,870,282 | | 2/1999 | André et al. . | |

* cited by examiner

*Primary Examiner*—Bryon P. Gehman
(74) *Attorney, Agent, or Firm*—Cislo & Thomas

(57) ABSTRACT

A carrying case with interchangeable side panels includes a suitcase and a number of ornamental side panels releasably attachable to the outside of the suitcase. The interchangeable ornamental side panels substantially cover the underlying structural side panels of the suitcase, and can be changed out without opening the suitcase or disassembling. This means the contents need not be disturbed in changing over the look and appearance of the carrying case, nor is the integrity of the suitcase compromised in any way. The carrying case may further include flanged framework around the interchangeable ornamental side panels to hold down the edges thereof. The flanged framework may be configured such that the ornamental side panel edges are tucked under. The carrying case may also be arrived at by simply reworking or converting a conventional suitcase.

8 Claims, 1 Drawing Sheet

CARRYING CASE WITH INTERCHANGEABLE SIDE PANELS

BACKGROUND OF THE INVENTION

1. Field of the Invention

The present invention relates generally to convertible luggage, and more particularly to a computer laptop carrying case or briefcase with interchangeable side panels to vary the ornamental appearance of the case.

2. Description of the Related Art

In this age of portable electronic computers, the design or fashion options for carrying cases remain quite limited. Black vinyl or leather bags are commonplace, as well as hard cases of various solid colors. The bland appearance of such conventional cases is believed justified by their perceived appropriateness for all occasions.

Still, it may be desirable to display an ornamental design coordinating with a user's outfit that day, a school emblem, a company logo, or an advertising slogan for an important client. Consequently, the prior art includes carrying cases having some adaptability, such as interchangeable side panels made possible by altering the structure of various cases. U.S. Pat. Nos. 3,575,226 and 3,738,458, issued to Chapman and Yount, respectively, are representative examples of such adaptable carrying cases.

Although adaptable cases such as those disclosed in the Chapman and Yount patents have proven generally suitable for their intended purposes, they possess inherent deficiencies which detract from their overall effectiveness and desirability. The Chapman and Yount cases are configured for partial structural disassembly to change the side panels, making those designs complex and costly.

That way of changing the panels also necessarily means the contents of the cases are potentially exposed while doing the changeover. Additionally, the integrity of the case may be generally compromised if it is more susceptible to being broken into or allowing moisture in around the side panels. Finally, the Chapman and Yount carrying cases are unique designs, seemingly eliminating the possibility of reworking the conventional carrying cases described above to add the interchangeability feature.

It would be an advance in the art to overcome these shortcomings and to resolve these disadvantages, in a manner to provide an improved and versatile carrying case that is useful and attractive.

OBJECTS OF THE INVENTION

It is an object of the present invention to provide a carrying case having interchangeable side panels not part of the structure of the overall case itself.

It is an additional object of the present invention that the interchangeable panels be securely retained once installed, although not requiring any disassembly of the carrying case structure to accomplish the installation.

It is an additional object of the present invention to provide a carrying case having interchangeable side panels, attachable and releasable while the contents of the case remain enclosed.

It is an additional object of the present invention to provide a carrying case having interchangeable side panels without compromising the integrity of the case to being tampered with or allowing the entry of foreign matter.

It is an additional object of the present invention to provide a kit for converting an existing conventional carrying case into one having interchangeable side panels which are easily changed out.

These and other objects and advantages of the present invention will be apparent from the description and drawings which follow.

SUMMARY OF THE INVENTION

The present invention specifically addresses the deficiencies of the prior art mentioned above, as well as the objects of the invention. More particularly, the present invention is a carrying case including a suitcase having structural side panels, and a number of ornamental side panels about the same size as the structural side panels for temporary attachment thereto on the outside of the suitcase. The ornamental side panels, not being part of the structure of the suitcase, may be interchanged without opening the suitcase or disassembling it in any way.

The ornamental side panels generally cover the underlying structural side panels, and are preferably attachable with conventional hook and loop fasteners, such as those sold under the Velcro® trademark. The suitcase may further include integral flanged framework surrounding each of the structural side panels outside the suitcase, configured such that the edges of the ornamental side panels may be tucked under the flanged framework when installing the same. That is, the flanged framework preferably provides a small clearance between itself and the structural side panel, slightly more than the thickness of the ornamental side panels.

The ornamental side panels may further include a small tag attached to a corner of each, for pulling the ornamental side panels out from under the flanged framework upon detaching a particular ornamental side panel. The small tag is preferably of a thickness substantially less than the clearance between the flanged framework and the structural side panel, thereby making it usable as a tool in tucking the edges of the ornamental side panels under the flanged framework.

A method for converting a suitcase into a carrying case having interchangeable side panels is also part of the invention. The method includes providing the suitcase having the structural side panels, providing the ornamental side panels, and releasably attaching one of the ornamental side panels to each of the structural side panels outside the suitcase. Still further, the method may include providing the small tag attached to the corner of each of the ornamental side panels, and pulling the tag to remove the ornamental side panels out from under the flanged framework.

These, as well as other advantages of the present invention will become more apparent from the following description and drawings. It is understood that changes in the specific structure shown and described may be made within the scope of the claims which follow without departing from the spirit of the invention.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
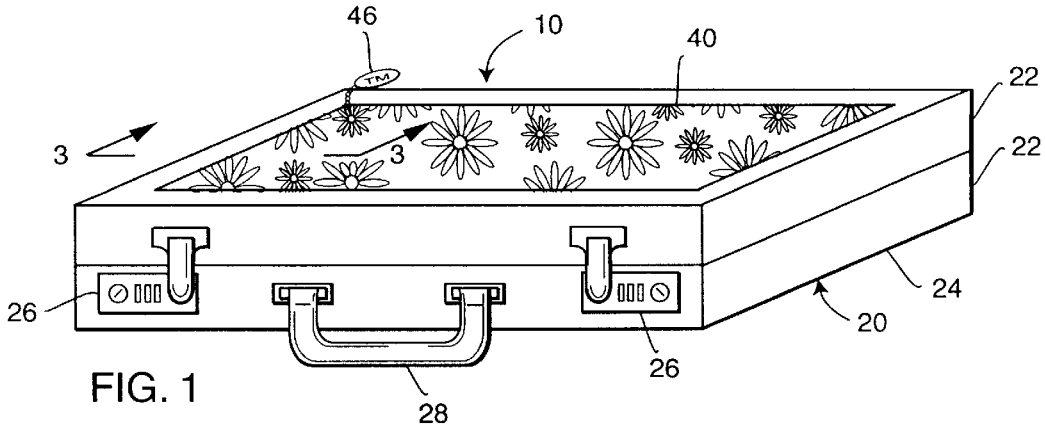
FIG. 1 is a perspective view of the preferred embodiment of the carrying case of the present invention.
Figure 2:
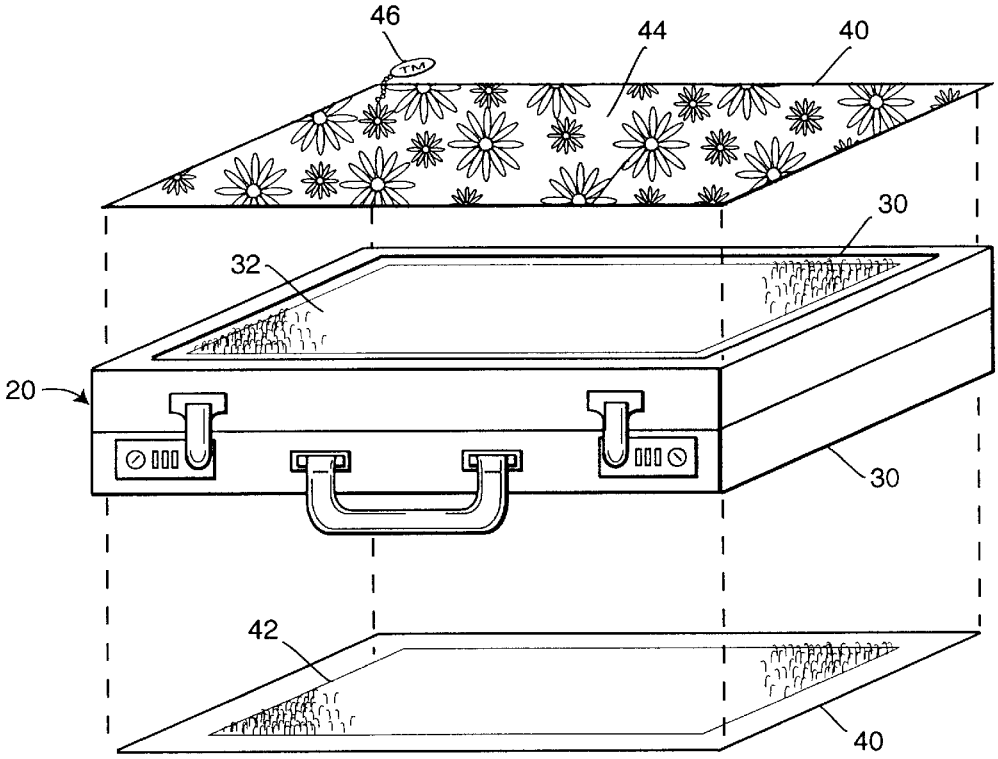
FIG. 2 is an exploded perspective view of the preferred embodiment showing the interchangeable side panels removed.
Figure 3:
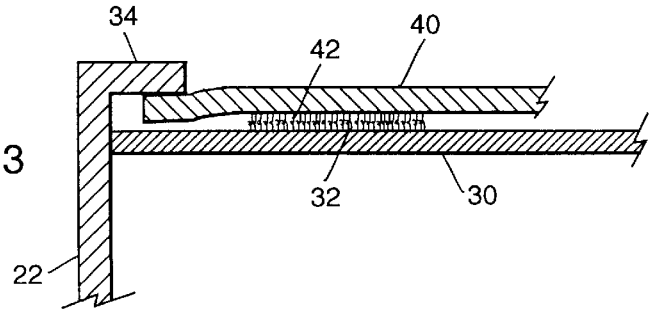
FIG. 3 is an enlarged section view of the attachment of the side panel to the case.

The carrying case with interchangeable side panels 10 of the present invention is illustrated in FIGS. 1 through 3, which depict presently preferred embodiments of the invention. Referring first to FIG. 1, shown is an overall top perspective view of the carrying case 10 including a suitcase 20 having two halves 22 which have been brought together to form a closed container 24. The suitcase 20 further includes a pair of conventional locking mechanisms 26 and a handle 28. The carrying case 10 is shown with a flowered pattern ornamental side panel 40.

Now also referring to the exploded view of FIG. 2 and the enlarged section view of FIG. 3, the preferred embodiments may be further described. Underlying the ornamental side panels 40 are structural side panels 30 of the suitcase 20. Attached to the top side of the structural side panels 30 as well as the underside of the ornamental side panels 40 are backings of complementary hook and loop fastening material 32, 42.

A pair of releasably-attachable ornamental side panels 40 are shown separated from the suitcase 20. Besides the flowered pattern 44, any checkerboard, stripes or other decorative pattern (not shown) may appear on the top sides of the ornamental side panels 40. Alternatively, advertising slogans or other printed matter (not shown) could appear on the ornamental side panels 40. The ornamental side panels 40 are about the same size as the underlying structural side panels 30.

The carrying case 10 may include flanged framework 34 surrounding the structural side panels 30, integral to the suitcase 20 as shown. Alternatively, separate flanged framework pieces (not shown) could be installed over the corners of a conventional suitcase. Provided under the flanged framework 34 is sufficient clearance for tucking in the edges of the ornamental side panels 40. The flanged framework 34 also serves the purpose of protecting and reinforcing the suitcase 20, as the corners are usually most susceptible to inadvertent brushing against walls and the like in carrying the suitcase 20.

Preferably, one of the corners of each of the ornamental side panels 40 also includes a releasably-attached tag 46. Besides possibly displaying a trademark, the tag 46 also serves as a pull chain enabling a portion of the ornamental side panel to be removed out from under the flanged framework 34. Further, the tag 46 is preferably detachable from the ornamental side panel 40, such that it may be utilized as a tool to tuck the edges of the ornamental side panel 40 under the flanged framework 34, before being reattached to the ornamental side panel 40.

Having described the structure of the preferred embodiment, it is now possible to describe its use. The carrying case 10 may be provided ready to use with a suitcase 20 (having integral flanged framework 34) and several sets of ornamental side panels 40. The user would select the desired ornamental side panels 40, and cover the underlying structural side panels 30 and mate the hook and loop fastening material 32, 42. Then the user would tuck the edges of the ornamental side panels 40 under the flanged framework 34. If necessary, the tag 26 could be detached and used to assist in tucking in the edges of the ornamental side panels 40, and then reattached to the lower corner of the ornamental side panel 40.

To interchange the ornamental side panels 40, the user would pull on the tag 26 to free a portion of the ornamental side panel 40 out from under the flanged framework 34, and then pull free the other edges and separate the hook and loop fastening material 32, 42 so as free the ornamental side panel 40 from the underlying structural side panel 30. Then a different ornamental side panel 40 would be installed as outlined above.

Alternatively, the carrying case 10 may be constructed from a conventional suitcase into the preferred embodiments described above. A kit to accomplish the rework or conversion may include a pair of separate flanged framework pieces 34, as well as the ornamental side panels 40 and hook and loop fastener material 32, 42. Other sundry items such as a general purpose glue or adhesive of some kind, and spacers might also be included as part of the kit.

Initially the separate flanged framework pieces 34 might be trimmed to fit, and installed around the structural side panels 30 on each half of the conventional suitcase, maintaining an appropriate gap between the flanges framework pieces 34 and the structural side panel 30 through use of a removable spacer. Then the ornamental side panels might be trimmed to fit, and the hook and loop fastening material 32, 42 installed onto the ornamental side panels 40 as well as the underlying structural side panels 30. The installation and subsequent interchanging of the ornamental side panels 40 would be performed as described above.

It is understood that the invention described herein and shown in the drawings represent only presently preferred embodiments of the invention. Indeed, various modifications and additions may be made to such embodiments without departing from the spirit and scope of the invention. These and other modifications and additions may be obvious to those skilled in the art and may be implemented to adapt the present invention for use in a variety of different applications.

What is claimed is:

1. A carrying case comprising:

a suitcase having two halves which may be brought together forming a closed container, each half having a structural side panel of substantial size; and a plurality of ornamental side panels about the same size as the structural side panels reasonably attachable over the structural side panels outside the closed container;

wherein the suitcase further includes flanged framework surrounding each of the structural side panels outside the closed container, the flanged framework configured such that edges of the ornamental side panels may be tucked under the flanged framework when attaching the ornamental side panels;

whereby the ornamental side panels substantially cover the structural side panels, and may be interchanged without opening the closed container or disassembling the suitcase.

2. The carrying case of claim 1 wherein the plurality of ornamental side panels are attachable to the structural side panels with hook and loop fasteners.

3. The carrying case of claim 1 wherein the flanged framework is integral to the suitcase.

4. The carrying case of claim 1 further including a small tag attached to a corner of each of the ornamental side panels, for pulling the ornamental side panels out from under the flanged framework.

5. The carrying case of claim 4 wherein the small tag is releasably attached to the ornamental side panel, and the small tag is of a thickness substantially less than the clearance between the flanged framework and the structural side panel, thereby making it usable as a tool in tucking the edges of the ornamental side panels under the flanged framework.

6. The carrying case of claim 1 wherein the flanged framework is configured to provide a small clearance between the flanged framework and the structural side panels, the clearance slightly greater than the thickness of the ornamental side panels.

7. A method for converting a suitcase into a carrying case having interchangeable side panels, the method comprising:

providing a conventional suitcase having two halves which may be brought together forming a closed container, each half having a structural side panel of substantial size, providing flanged framework configured to surround each of the structural side panels outside the closed container; and providing a plurality of ornamental side panels about the same size as the structural side panels;

releasably attaching one of the ornamental side panels over each of the structural side panels outside the closed container;

tucking the ornamental side panels under the flanged framework.

8. The method of claim 7 further comprising:

providing a small tag attached to a corner of each of the ornamental side panels; and pulling the tag to remove the ornamental side panels out from under the flanged framework.

* * * * *